US007155149B2

(12) United States Patent
Fujii et al.

(10) Patent No.: US 7,155,149 B2
(45) Date of Patent: Dec. 26, 2006

(54) IMAGE FORMING APPARATUS WHICH DETECTS ABNORMALITY CONDITION IN FEEDING OF TONER

(75) Inventors: Ritsuo Fujii, Hachioji (JP); Seiji Yamaguchi, Hino (JP); Hiroshi Isokawa, Hino (JP); Yasuo Shiokawa, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 239 days.

(21) Appl. No.: 10/847,845

(22) Filed: May 17, 2004

(65) Prior Publication Data

US 2005/0041998 A1 Feb. 24, 2005

(30) Foreign Application Priority Data

Aug. 19, 2003 (JP) ..... 2003-294948

(51) Int. Cl.
*G03G 15/08* (2006.01)

(52) U.S. Cl. ..... 399/258

(58) Field of Classification Search ..... 399/27, 399/34, 35, 258, 262, 358, 359, 360, 119
See application file for complete search history.

(56) References Cited

U.S. PATENT DOCUMENTS 5,521,690 A * 5/1996 Taffler et al. ..... 399/93
5,592,267 A * 1/1997 Misago et al. ..... 399/62
5,815,784 A * 9/1998 Kasahara et al. ..... 399/358
5,987,298 A * 11/1999 Muramatsu et al. ..... 399/359
6,112,046 A * 8/2000 Suzuki et al. ..... 399/359
6,826,381 B1 * 11/2004 Muramatsu et al. ..... 399/260
2001/0041083 A1 11/2001 Terazawa et al.

FOREIGN PATENT DOCUMENTS

JP 2000066557 A * 3/2000
JP 2000-137376 A 5/2000
JP 2000293079 A * 10/2000
JP 2000305354 A * 11/2000

* cited by examiner

*Primary Examiner*—Robert Beatty
(74) *Attorney, Agent, or Firm*—Frishauf, Holtz, Goodman & Chick, P.C.

(57) ABSTRACT

An image apparatus comprising a toner supplying device; a toner receiving device; a first toner conduit communicating with the toner receiving device to feed a toner supplied from the toner supplying device; a first feeding device which forms an air stream to feed the toner through the first toner conduit; and a detector which monitors abnormality condition in the course of toner supplying in the apparatus.

19 Claims, 10 Drawing Sheets

IMAGE FORMING APPARATUS WHICH DETECTS ABNORMALITY CONDITION IN FEEDING OF TONER

BACKGROUND OF THE INVENTION

1. Technical Field

The invention relates to an image forming apparatus, particularly, technology to supply toner to the electrophotographic image forming apparatus which forms images on the recording material.

2. Related Art

For copying machines, printers, facsimile machines, and multi-functional image forming apparatuses including functions of the machines stated above, particularly for electrophotographic image forming apparatuses, speedup and coloring are in progress.

In high-speed image forming apparatuses, since a large amount of toner is consumed, a toner storing section of a large capacity suitable for high-speed performance of the high-speed image forming apparatuses is needed, which tends to make the space used by the toner storing section in the apparatuses large. Further, also in color image forming apparatuses, the space used by a toner storing section that stores toners of four colors tends to be large.

In typical image forming apparatuses, a toner storing section is located in the vicinity of a developing device. Therefore, as the space used by the toner storing section becomes larger as described above, it becomes more difficult to dispose the toner storing section in the vicinity of the developing device, which is a problem.

In TOKKAI No. 2000-137376, it is disclosed that toner is supplied from a toner storing section to a developing device by conveying a mixed fluid of toner and air with the use of an air pump.

A method disclosed in TOKKAI No. 2000-137376 allows a toner storing section to be arranged at a position distant from a developing device, giving a wider choice of the location of the toner storing section, and thus, the problem of arranging a toner storing section with a large capacity or a toner storing section of color toner is solved.

In the invention disclosed in TOKKAI No. 2000-137376, a first pump for supplying toner and a second pump for returning air to a toner storing section are used.

A toner supplying device disclosed in TOKKAI No. 2000-137376 that supplies toner through toner conduits with the use of a pump, as described above, is suitable for high-speed image forming apparatuses and color image forming apparatuses, but, if the apparatuses are used for a long time, failure in toner conveyance may be caused. For example, it is possible that the conduit is clogged with toner, air leaks at a joint section of the conduits occurs, or toner gets aggregated in a toner conveyance system, causing a failure in toner conveyance.

In the case where such a conveyance failure occurs, if a pump continues to run, it may cause a trouble of the apparatus. That is, if the pump continues to run with a conveyance failure, the conveyance system may be clogged with toner to be an unrecoverable failure, resulting in a requirement of replacing conduits.

It is desired that the above described problem with a toner supplying device for supplying toner with a pump is solved so that an image forming apparatus provided with a detection system capable of early detection of failure in toner conveyance is offered.

SUMMARY OF THE INVENTION

A first aspect of the invention is an image forming apparatus comprising a toner supplying device; a toner receiving device; a first toner conduit communicating with the toner receiving device to feed a toner supplied from the toner supplying device; a first feeding device which forms an air stream to feed the toner through the first toner conduit; and a detector which monitors an abnormality condition in feeding of the toner from the toner supplying device.

A second aspect of the invention is a toner supplying method comprising sucking a toner contained in a toner supplying device; conveying the toner through a toner conduit to supply the toner to a predetermined position; and detecting an abnormality condition in the supply of the toner.

BRIEF DESCRIPTION OF THE DRAWING

DETAILED DESCRIPTION OF THE EXEMPLARY EMBODIMENTS (1) Image Forming Apparatus FIG. 1 shows an example of an image forming apparatus according to an embodiment of the present invention.

The image forming apparatus comprises automatic document feeder 20, document reading section 21, image forming section 22, fixing device 8, and a sheet feeding section.

Figure 1:
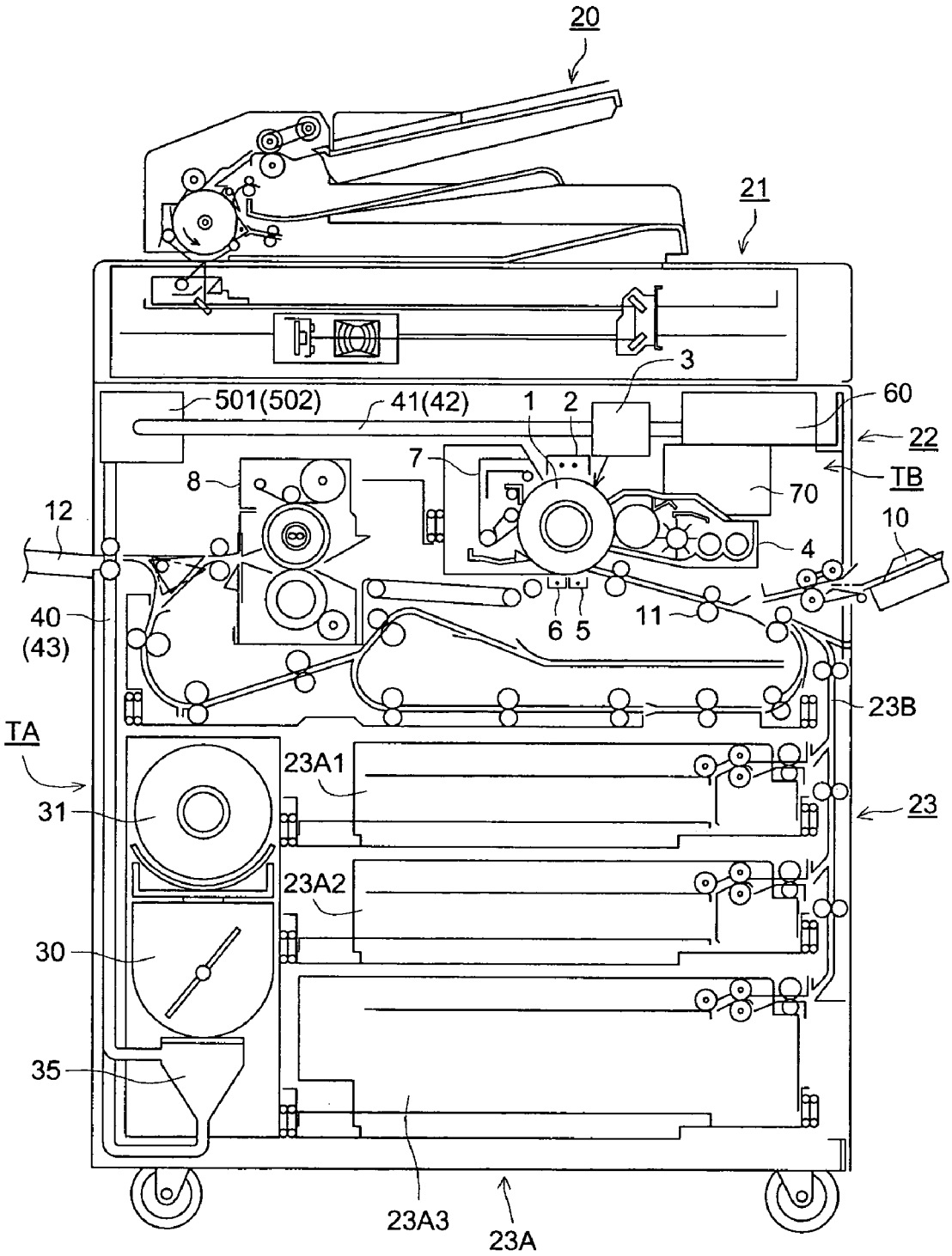
FIG. 1 is a schematic diagram showing an example of an image forming apparatus.

In FIG. 1, the automatic document feeder 20 conveys sheets of a document mounted on a document feeding table thereof to a reading position one by one and stacks the sheets of the document read on a document ejection tray.

The document reading section 21 reads images of the document and generates digital image data.

The image forming section 22 electrophotographically forms images on recoding sheets, wherein in the image forming section 22, charging device 2, exposure device 3, developing device 4, transfer device 5, and cleaning device 7 are disposed around drum-shaped photoconductor 1 serving as an image carrying member. Below the image forming section 22, sheet feeding section 23 having a recording sheet(image support) storing section provided with a plurality of sheet feeding trays and a sheet feeding section is arranged to feed recording sheets to the image forming section 22. Reference numeral 10 denotes a manual sheet feeding section. A recording sheet fed from the sheet feeding section 23 or the manual sheet feeding section 10 is supplied between the photoconductor 1 and the transfer device 5 by registration roller 11, then, fixed by fixing device 8, and is ejected to sheet ejection tray 12.

The sheet feeding section 23 comprises recording sheet storing section 23A having three sheet feeding trays 23A1, 23A2, and 23A3 and sheet feeding section 23B disposed at the side of the sheet storing section 23A.

Clockwise rotation of the photoconductor 1, charging by the charging device 2, imagewise exposure by the exposure device 3, and developing by the developing device 4 form a toner image on the photoconductor 1. The toner image thus formed is transferred onto a recording sheet by the transfer device 5. The recording sheet onto which the toner image has been transferred is subjected to fixing process by the fixing device 8 and then ejected to the sheet ejection tray 12.

Each of color image forming apparatuses is provided with an image forming section for forming yellow images, an image forming section for forming magenta images, an image forming section for forming cyan images, and an image forming section for forming black images, wherein each image forming section has a developing device.

Further, as a transfer device that transfers a toner image formed on an image carrying member onto a recording sheet, it is also allowed to use a transfer device comprising primary transfer means, an intermediate transferrer, and secondary transfer means, wherein the toner image formed on the image carrying member is transferred onto the intermediate transferrer by the primary transfer means, and then the toner image on the intermediate transferrer is transferred onto the recording sheet by the secondary transfer means.

The developing device 4 develops an electrostatic latent image on the photoconductor 1 with a two-component developer containing toner and carrier, or with a single component developer that contains no carrier, but contains toner or contains both toner and additives. A predetermined amount of developer is stored in the developing device 4, and in the case where a two-component developer is used, toner in a quantity equivalent to that of the toner consumed in developing is supplied from a toner feeding section TA described below so that the toner concentration of the developer in the developing device 4 is maintained constantly at a predetermined amount. Also, in a developing device using a single component developer, toner is supplied likewise to maintain the amount of the developer in the developing device at a predetermined amount constantly. In the present specification, the toner of a two-component developer and a single component developer are referred to as 'toner'.

The toner feeding section TA is provided with toner container 31. The toner feeding section TA is also comprised of toner hopper 30, which is an example of a toner storing chamber, and funnel-shaped mixing chamber 35, wherein toner separation section 60 disposed in the vicinity of the developing device 4 and the toner feeding section TA disposed at a position distant from the developing device 4 are connected by conduits 40 to 43.

(2) Toner Supplying Device

Figure 2:
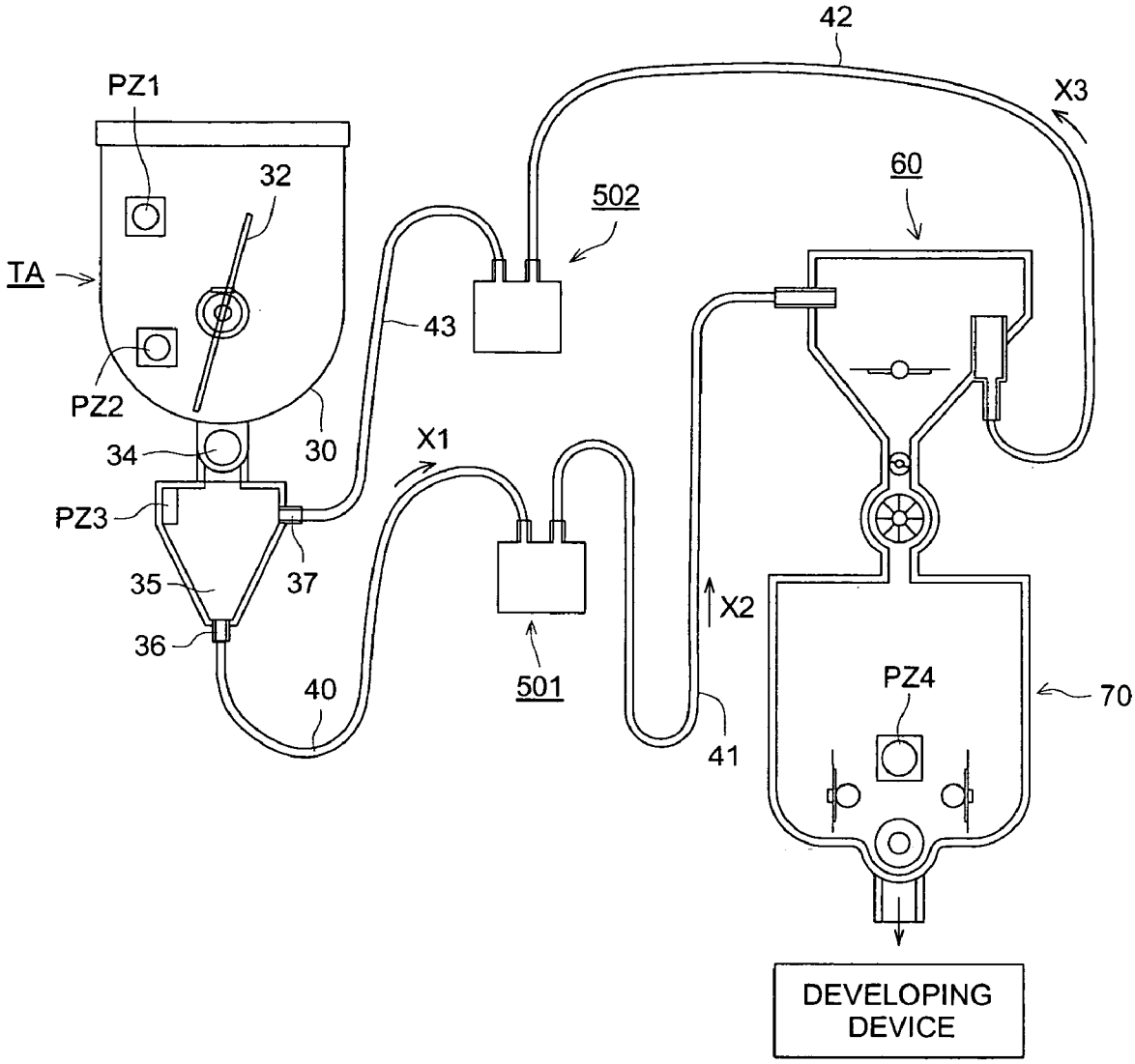
FIG. 2 is a diagram showing an example of a toner supplying device.
Figure 3:
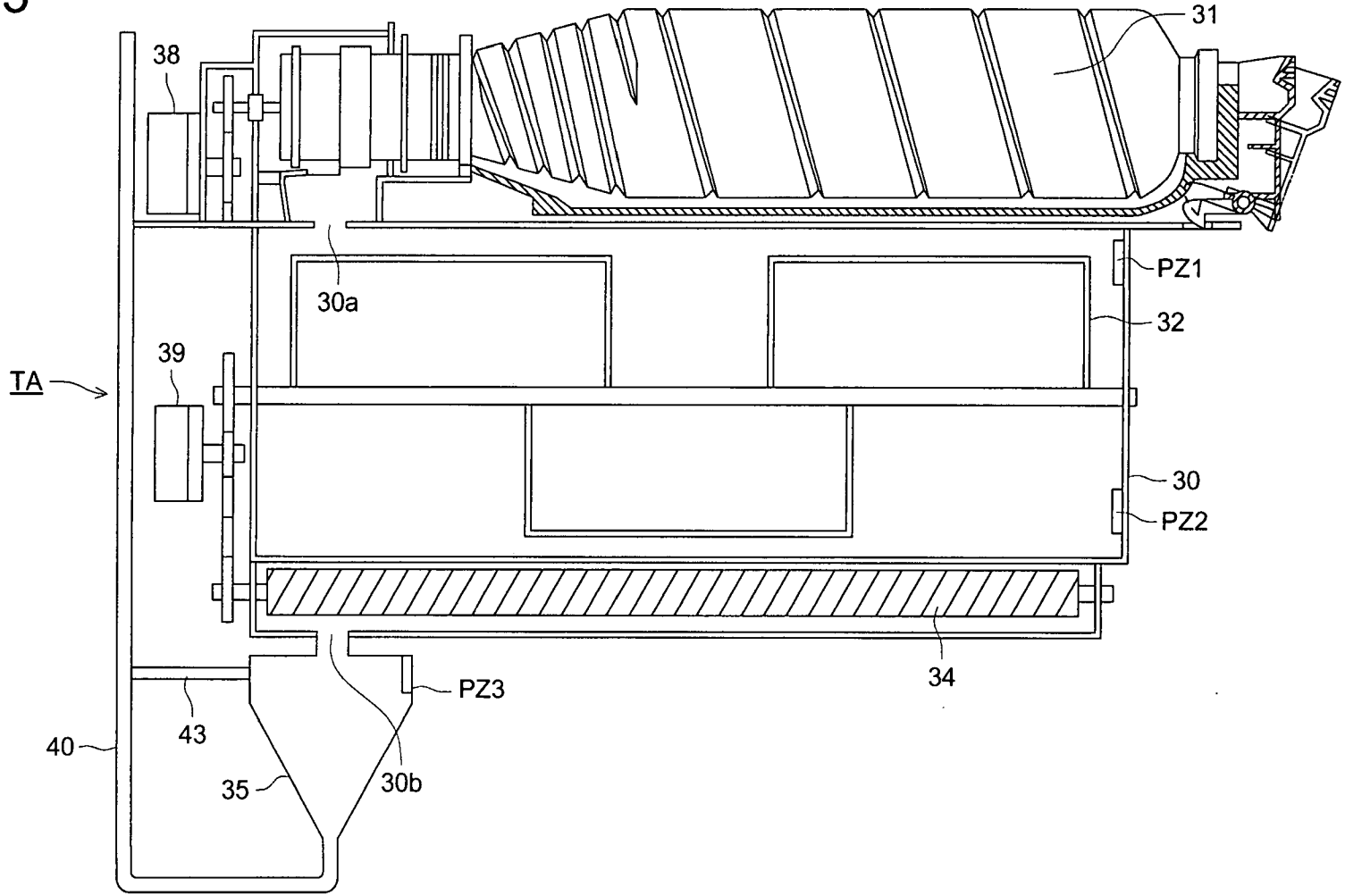
FIG. 3 is a diagram showing an example of a toner feeding section.

FIG. 2 shows a toner supplying device of the image forming apparatus according to the embodiment, as an example, of the invention shown in FIG. 1, and FIG. 3 shows an example of a toner feeding section that stores and feeds toner.

The toner supplying device is comprised of toner feeding section TA (in this example, constructed of toner container 31, toner hopper 30, and mixing chamber 35), a pump 501 serving as a pump for supplying toner, a pump 502 for returning air, toner receiving section TB (constructed of separation section 60, toner hopper 70, etc.), toner supplying conduits 40 and 41, and air returning conduits 42 and 43.

The pump 501 is disposed at the joint section between the toner supplying conduit 40 extending upward from the toner feeding section TA and the supplying conduit 41, and the pump 502 is disposed at the joint section between the air returning conduit 43 and the returning conduit 42, wherein the conduits 41 and 42 are arranged almost horizontally. The toner supplying conduit 40 connects the toner feeding section TA to the pump 501, and the air returning conduit 43 connects the toner feeding section TA to the pump 502. The toner supplying conduit 41 connects the pump 501 to the toner receiving section TB, and the air returning conduit 42 connects the toner receiving section TB to the pump 502.

(3) Toner Feeding Section

Figure 4:
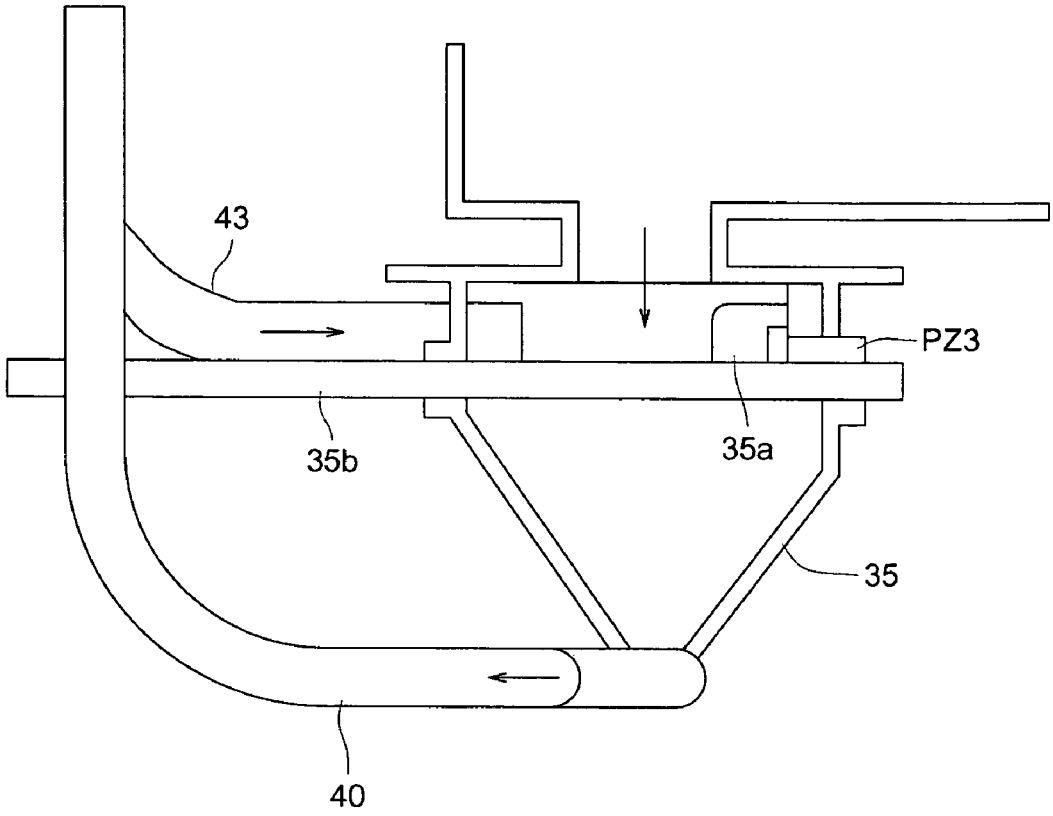
FIG. 4 is a diagram showing an example of a mixing chamber.

The toner feeding section TA will be explained referring to FIG. 3 showing a side cross-sectional view of the toner feeding section TA and FIG. 4 showing the mixing chamber 35. The toner feeding section TA is essentially comprised of the toner storing chamber and the mixing chamber 35 for mixing toner and air.

Although the toner storing chamber is comprised of the toner container 31 and the toner hopper 30, in the shown example, construction without the toner container 31 is also allowed. That is, the toner storing chamber may be constructed only of a toner hopper, wherein toner is supplied from an external toner container, a toner bag, or the like.

The toner feeding section TA is disposed on a side of recording sheet storing section 23A, the side being opposite to the other side of the recording sheet storing section 23A, where sheet feeding section 23B is arranged.

Such an arrangement allows disposing the toner feeding section TA that stores and feeds toner, without affecting the disposition of other components, and permits the capacity of the toner storing chamber to be large enough. Further, it is also possible to dispose a toner storing section for color toner.

The toner feeding section TA is comprised of the toner hopper 30 and the funnel-shaped mixing chamber 35. The toner feeding section TA is provided with the cylindrical toner container 31, wherein the toner container 31 is rotationally driven by motor 38, thereby dropping toner from the toner container 31 into the toner hopper 30 through opening 30*a*. The toner hopper 30 is provided with bar-shaped agitating member 32 formed with a plurality of U-shaped portions, and with conveying screw 34 at a lower portion thereof.

Rotation of motor 39 rotates the agitating member 32 and the conveying screw 34, and thus toner drops from the toner hopper 30 into the mixing chamber 35 through opening 30*b*.

Since air is supplied to the mixing chamber 35 through the conduit 43, a fluid that is a mixture of toner and air is formed.

FIG. 4 shows the mixing chamber 35 for mixing toner and air. As explained above, the conduit 40 and the conduit 43 are connected to the mixing chamber 35. The mixing chamber 35 is further provided with toner sensor PZ3, which is a piezoelectric sensor, to detect that the mixing chamber 35 is filled with toner, that is, toner is accumulated to a level equal to or higher than a predetermined level. The toner sensor PZ3 is cleaned with cleaning member 35B of a deformable plate made of a material such as PET so that a required sensitivity is maintained. Cleaning member 35A is integrally fixed to shaft 35B which is driven and rotated by the motor 39 (shown in FIG. 3) so that the toner sensor PZ3 is cleaned by rotation.

(4) Fluid Conveying Means

Figure 5:
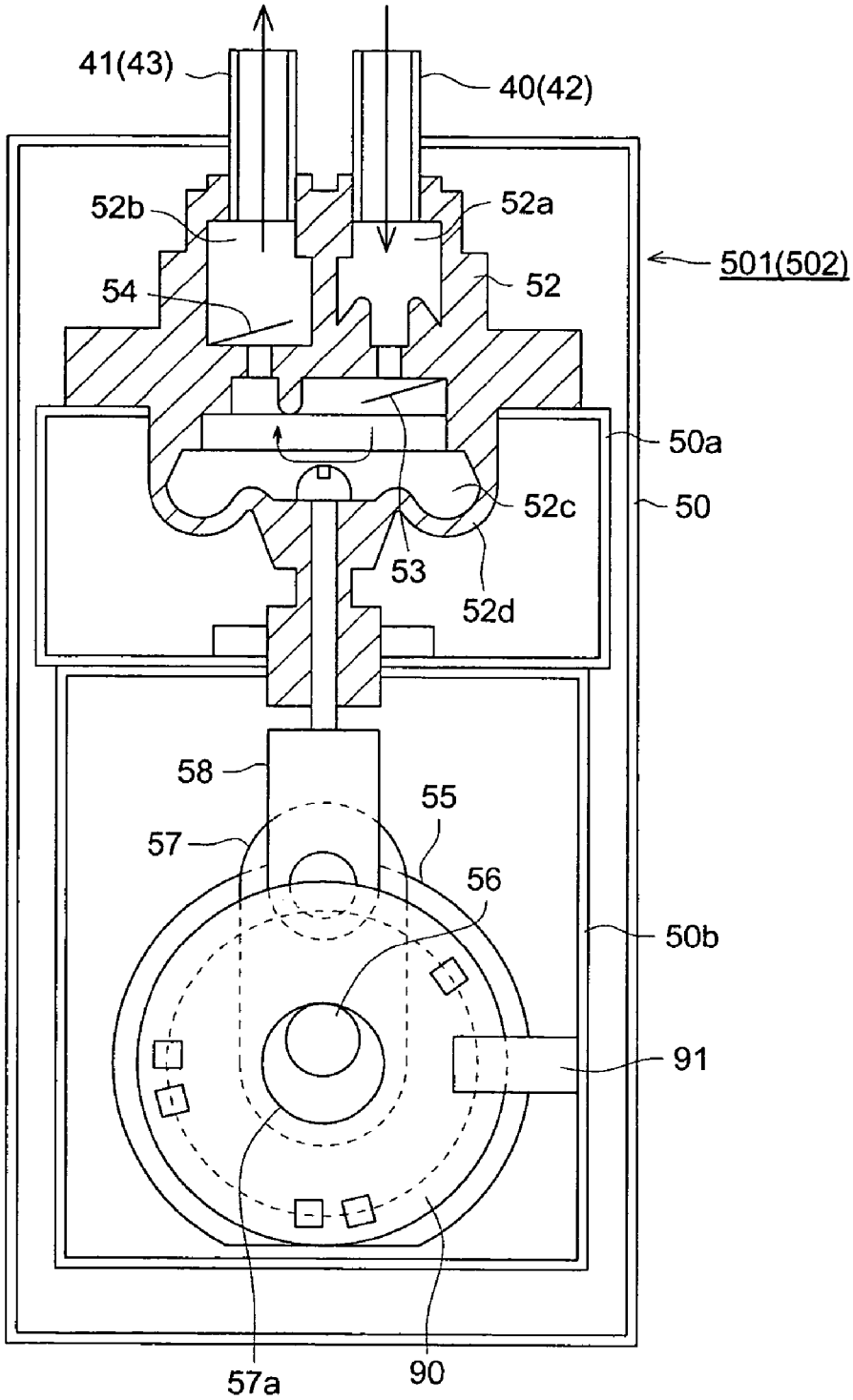
FIG. 5 is a diagram showing an example of a pump.

To convey the mixed fluid of toner and air from the toner feeding section TA to the toner receiving section TB, and convey the air separated from the toner, from the toner receiving section TB to the toner feeding section TA, there are provided pumps which are diaphragm pumps 501 and 502 shown in FIG. 5. However, any known pump such as, for example, screwpumps disclosed in TOKKAIHEI No. H7-219329 and H8-6368 can be used. The pump 501 functions as a supplying pump for conveying the mixed fluid of toner and air from the toner feeding section TA to the toner separation section 60, and the pump 502 functions as a returning pump for returning the air from the toner separation section 60 to the toner feeding section TA. Although, in the shown example, the pumps 501 and 502 have the same structure, the supplying pump and the returning pump may be of different structures or different types.

In the shown example, the pumps are disposed above the toner feeding section TA.

Such disposition of pumps allows it to arrange pumps between conduits, using linear conduits, thereby to prevent the fluid conveying system from being clogged, and to make remove clogging easily when it occurs.

The pumps 501 and 502 will be explained referring to FIG. 5. The pumps 501 and 502 are diaphragm pumps of the same structure as shown in FIG. 5.

The pumps 501 and 502 are provided with outer frame 50, and pump frame 50A and motor frame 50B in the outer frame 50. The suction inlet of the pump 501 is connected to the conduit 40, and the exhausting outlet thereof is connected to the conduit 41. The suction inlet of the pump 502 is connected to the conduit 42, and the exhausting outlet thereof is connected to the conduit 43. Suction chamber 52A, exhausting chamber 52B, and pressure chamber 52C are formed inside chamber-shaped body 52 that is made of rubber.

Between the suction chamber 52A and the pressure chamber 52C, and between the exhausting chamber 52B and the pressure chamber 52C, there are provided respectively communicating holes, as shown, and the communicating holes are respectively equipped with valves 53 and 54. Diaphragm 52D is formed as a part of the chamber-shaped body 52.

Each of the valves 53 and 54 is constructed of a deformable plate. The valves 53 and 54 are shown in the state that the both valves 53 and 54 are open so as to be visible in the figure, but, in practical operation, when one of the valves is open, the other one is closing the communicating hole there, and when the one of the valves is closing the communicating hole there, the other one is open. Thus, the valves perform alternate valve operations.

Motor 55 rotates eccentric cam 56; this rotation moves link 57 having holes 57A up and down, the link 57 serving as a cam-follower; thereby diaphragm driving member 58 connected to the link 57 moves up and down; and thus the diaphragm 52D is deformed. The diaphragm 52D varies the volumetric capacity of the pressure chamber 52C, thereby varying the chamber pressure. This pressure variation alternately opens and closes the valves 53 and 54 to convey the fluid in one direction shown by the arrow.

(5) Toner Separation Section

The toner separation section 60 separates toner from the fluid and supplies the toner to the developing device, wherein the separated toner is dropped onto the developing device through the toner hopper 70, and thus the toner supplying mechanism is simplified. Accordingly, the toner separation section 60 is disposed above the developing device.

Figure 6A:
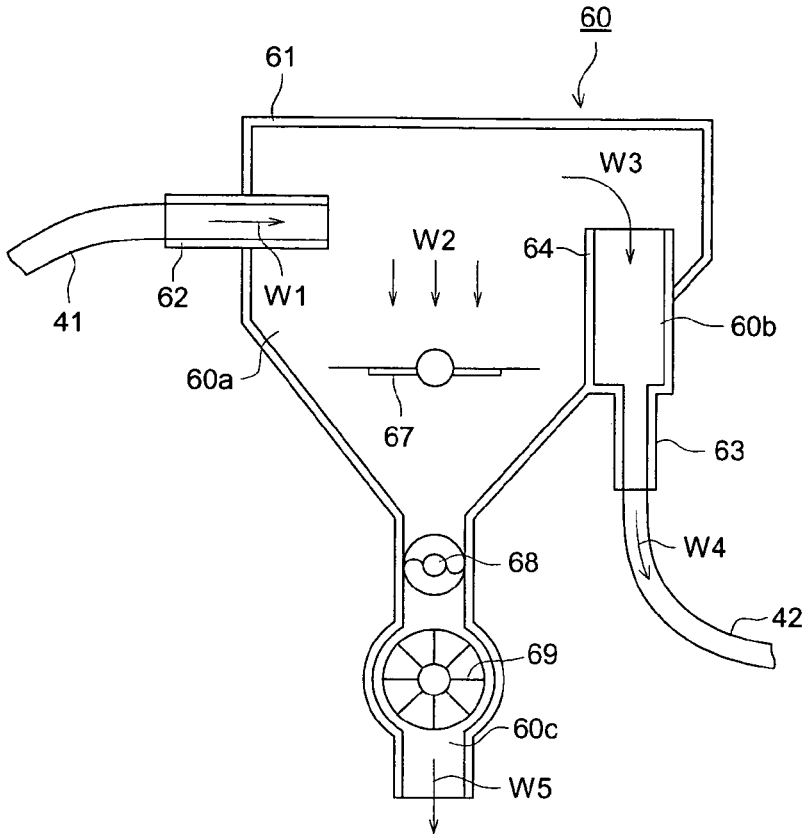
FIG. 6A is a front cross-sectional view showing an example of a toner separation section.
Figure 6B:
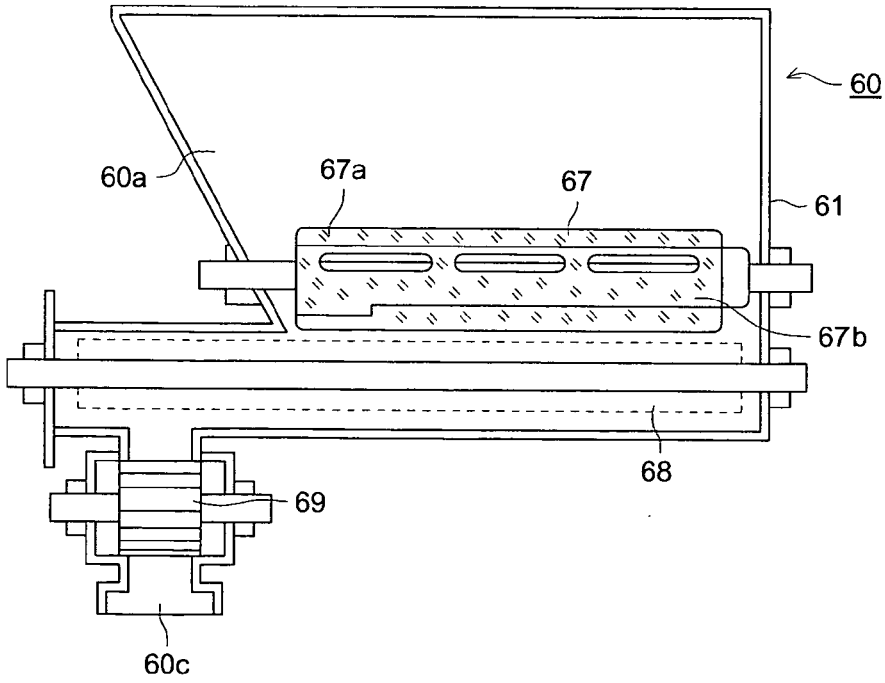
FIG. 6B is a side cross-sectional view showing the example of the toner separation section.

Next, the toner separation section 60 will be explained referring to FIGS. 6A and 6B. FIG. 6A is a front cross-sectional view, and the FIG. 6B is a side cross-sectional view.

The toner separation section 60 is formed with toner inlet chamber 60A and toner exhausting section 60C by outer wall 61 that forms the outer shape of the toner separation section 60, and formed with air exhausting chamber 60B by bridge 64 provided in the toner inlet chamber 60A.

The toner inlet chamber 60A is provided with air inlet opening 62, and the air exhausting chamber 60B is provided with air exhausting outlet 63. Toner exhausting section 60C arranged below the toner inlet chamber 60A is provided with screw 68 and rotary valve 69. Almost at the center of the toner inlet chamber 60A, agitating member 67 is arranged. The agitating member 67 is comprised of agitating blades 67*a* and 67*b* which are fixed to a rotary shaft, as shown in FIG. 6B, wherein the agitating blade 67*a* is a metal plate, and the agitating blade 67*b* is a plate made of an elastic material such as PET. Rotary valve 69 is constructed of a plurality of plates, which are arranged in parallel to the rotary shaft to restrict a free flow of air and to convey toner downward as viewed in the figure.

As shown by arrow W1, from the mixed fluid of air and toner taken in from the conduit 41, the toner is subjected to gravity separation in the air inlet chamber 60A, as shown by arrow W2, then, conveyed by the screw 68, and exhausted from the toner exhausting section 60C by the rotary valve 69 to be supplied to the developing device. On the other hand, the air separated from the toner enters the air exhausting chamber 60B, as shown by arrow W3, and goes out from the exhausting outlet 63 into the conduit 42 to be moved in direction W4. The agitating member 67 prevents toner from remaining in the toner separation section 60.

(6) Toner Hopper (on the Toner Receiving Section Side)

Figure 7:
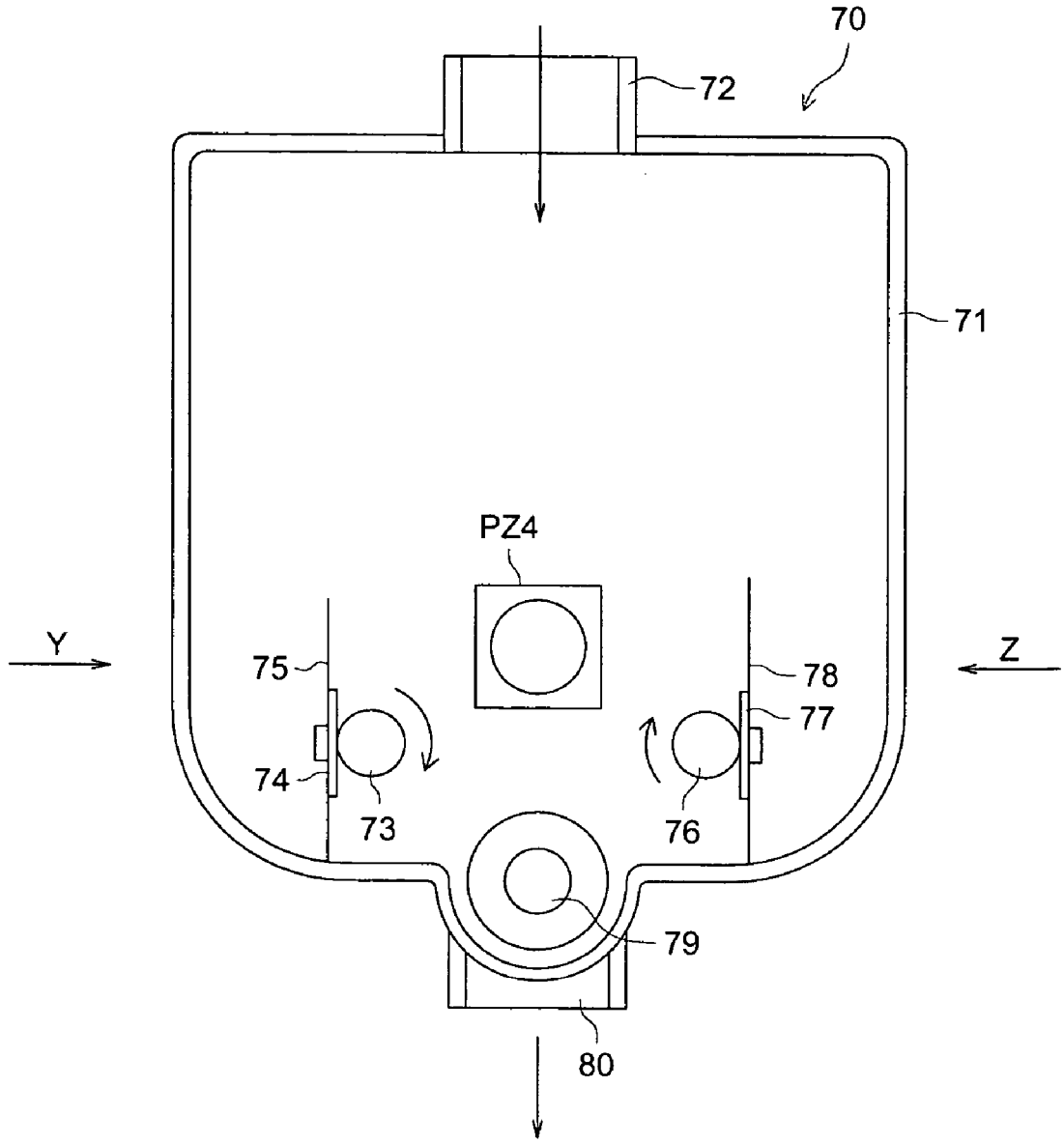
FIG. 7 is a front cross-sectional view showing an example of a toner hopper.
Figure 8:
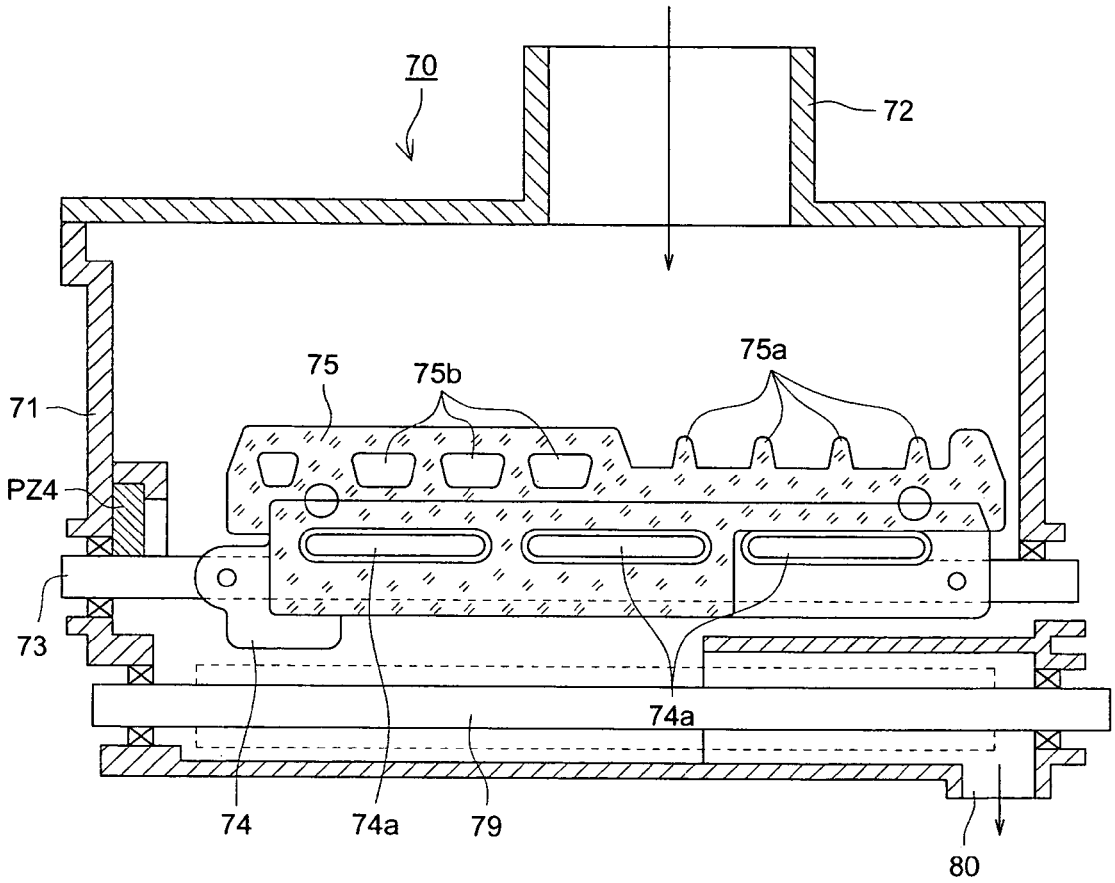
FIG. 8 is a side cross-sectional view showing the example of the toner hopper.
Figure 9A:
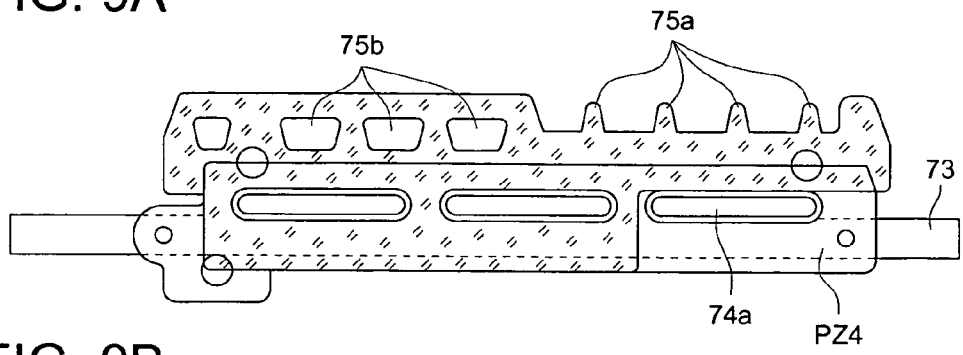
FIGS. 9A and 9B each is a diagram showing an example of an agitating member.
Figure 9B:
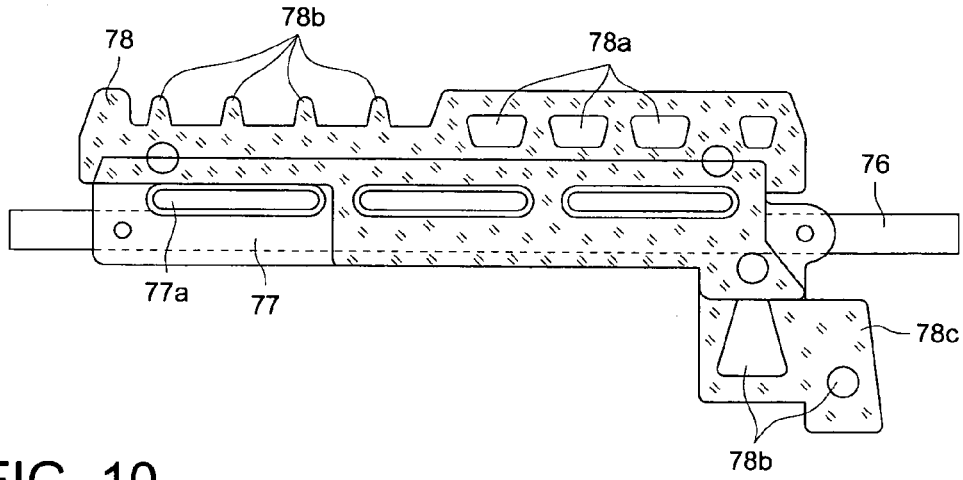

The toner hopper 70 will be explained referring to FIGS. 7 to 9B. FIG. 7 is a front cross-sectional view of the toner hopper 70; FIG. 8 is a side cross-sectional view of the toner hopper 70; and FIGS. 9A and 9B are diagrams showing agitating members. FIG. 9A is a side view of an agitating member viewed from direction Y in FIG. 7, and FIG. 9B is a side view of an agitating member viewed from direction Z in FIG. 7.

Between the toner separation section 60 and the developing device, there is arranged the toner hopper 70 for temporarily storing toner. The toner hopper 70 has an outer shape formed by housing 71, toner inlet 72, and toner outlet 80, wherein the toner housing 71 is provided therein with the two agitating members and screw 79.

One of the agitating members is comprised of rotary shaft 73 and agitating blades 74 and 75 fixed to the rotary shaft 73. The agitating blade 74 is made of a metal plate, having holes 74A for reducing the resistance received from the toner in rotationally agitating the toner. The agitating blade 75 is an elastic film, the elastic film being adhered to the agitating blade 74 and made of a material such as PET, and has protrusions 75A and holes 75B for reducing the resistance received from the toner in rotationally agitating the toner.

The other agitating member is comprised of rotary shaft 76 and agitating blades 77 and 78 fixed to the rotary shaft 76. The agitating blade 77 is made of a metal plate, having holes 77A for reducing the resistance received from the toner in rotationally agitating the toner. The agitating blade 78 is an elastic film, the elastic film adhered to the agitating blade 77 and made of a material such as PET, and has protrusions 78A and holes 78B for reducing the resistance received from the toner in rotationally agitating the toner.

The agitating blade 78 also has protrusion 78C for scraping and cleaning the surface of toner sensor PZ4.

The toner is dropped and taken in through the toner inlet 72, and then dropped from the toner outlet 80 to be supplied to the developing device. In the toner hopper 70, the toner is rotationally agitated by the two agitating members, wherein the protrusion 78C of the agitating blade 78 cleans the toner sensor PZ4 to maintain a required sensitivity of the toner sensor PZ4.

(7) Toner Supplying Operation

Toner supplying operation will now be explained referring to FIGS. 1 to 10.

Figure 10:
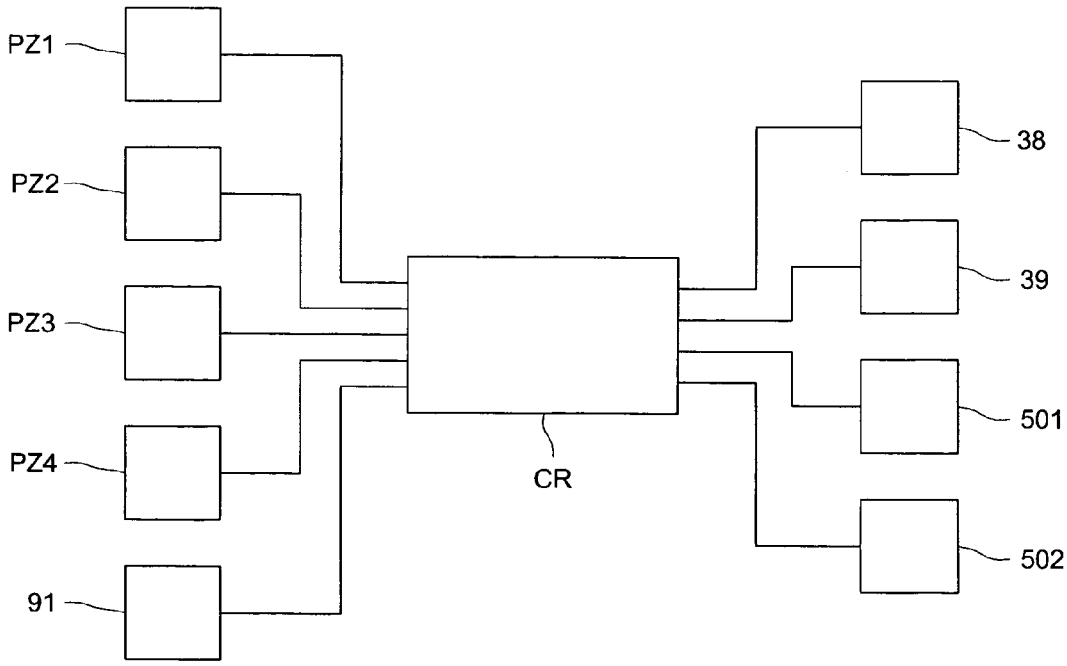
FIG. 10 is a block diagram showing a control system.

FIG. 10 is a block diagram of a control system that performs control of toner supply.

Toner is supplied from the toner container 31 to the toner hopper 30, wherein toner supply to the toner hopper 30 is controlled by toner sensor PZ1. The toner sensor PZ1 is a piezoelectric element and is disposed in the toner hopper 30 at a position for detecting that the toner hopper 30 is filled with toner. Toner sensor PZ2 is also a piezoelectric element that detects toner levels lower than the toner sensor PZ1, and when the toner sensor PZ2 detects a toner level lower than a predetermined level, a warning that calls for mounting a new toner container 31 and supplying toner is displayed on an operation section (not shown).

When the toner sensor PZ1 detects that the toner level becomes equal to or lower than a predetermined level, control means CR starts the motor 38 to supply toner from the toner container 31 to the toner hopper 30. When the toner sensor PZ1 detects that the toner level becomes equal to or higher than the predetermined level, the control means CR stops the motor 38 to terminate toner supply. Thus, the toner level inside the toner hopper 30 is maintained at the predetermined level.

The toner hopper 30 has a capacity almost equal to that of the toner container 31. Therefore, the toner feeding section TA has a capacity almost twice as large as that of the toner container 31, and accordingly, even when no toner is left in the toner container 31, image forming is prevented from stopping due to running out of toner.

When toner in the toner container 31 is used up, toner in the toner hopper 30 decreases with consumption thereof by image forming. If the toner level does not reach the predetermined level in the toner hopper 30 even after the control means CR performs toner supply for a predetermined time, driving the motor 38, the control means CR stops toner supply to the toner hopper 30.

If image forming is continued in this state and the toner level in the toner hopper 30 drops, the toner sensor PZ2 performs detection of the toner level, and a warning calling for a replacement of the toner container 31 is displayed.

Toner conveyance from the toner hopper 30 to the mixing chamber 35 is performed by driving the screw 34 with the motor 39. Toner supply from the toner feeding section TA to the toner separation section 60 is performed by the pump 501, wherein toner supply by the motor 39 and toner supply by the pump 501 are carried out according to a detection signal from toner sensor PZ4 which is arranged between the toner separation section 60 and the developing device 4 and detects the toner level in the toner hopper 70. That is, according to an output from the toner sensor PZ4 having detected that the toner level in the toner hopper 70 has dropped down to a level equal to or lower than the predetermined level, the control means CR starts the motor 39 and the pumps 501 and 502 to supply toner, and, according to an output from the toner sensor PZ4 having detected that the toner level has risen to a level equal to or higher than the predetermined level, the control means CR stops the motor 39 and the pumps 501 and 502 to stop supplying toner.

As shown in FIG. 2, the mixing chamber 35, the pumps 501 and 502, and the toner separation section 60 are connected by the conduits 40 to 43.

The toner is supplied by the pump 501 in a way that the mixed fluid is conveyed from the mixing chamber 35 to the pump 501, as shown by arrow X1, and conveyed from the pump 501 to the toner separation section 60, as shown by arrow X2, then, the air is returned by the pump 502 in a way that the air is conveyed from the toner separation section 60 to the pump 502, as shown by arrow X3, and conveyed from the pump 502 to the mixing chamber 35, as shown by arrow X4. The toner is separated by the toner separation section 60 and supplied to the toner hopper 70 by the screw 68.

The motors 55 start running in response to the above described detection signal and respectively operate the pumps 501 and 502; the pumps 501 and 502 generate an air stream in the mixing chamber 35 and mix toner and air; and then, the pump 501 conveys the mixed fluid through the conduits 40 and 41 to the toner separation section 60.

The toner having been separated by the toner separation section 60 is supplied by the screw 68 to the developing device 4 through the toner hopper 70 (in direction W5), while the separated air is returned to the mixing chamber 35 by the pump 502 through the conduits 42 and 43.

The toner supplied from the toner separation section 60 to the toner hopper 70 is conveyed by screw 79 and supplied to the developing device 4. The toner amount in the toner hopper 70 is monitored by the toner sensor PZ4 to be maintained constant.

Next, the operation timing of the pumps 501 and 502 will be explained referring to FIG. 11.

According to the above described signal from the toner sensor PZ4 having detected that the toner level in the toner hopper 70 has dropped down to a level equal to or lower than the predetermined level, toner supply is started, wherein the pump 502 starts at time t1, and then the pump 501 starts at time t2.

After the toner supply is performed by the operation of the pumps 501 and 502, toner supply is stopped according to the signal of the toner sensor PZ4 having detected that the toner level in the toner hopper 70 has risen to a level equal to or higher than the predetermined level, wherein the pump 501 stops at time t3, and then the pump 502 stops at time t4.

As mentioned above, in starting toner supply, the pump 502 starts earlier than the pump 501, and thereby the pressure in the toner mixing chamber 35 temporarily rises. This pressure rise generates a flow of the fluid that exhausts toner from the mixing chamber, and thus the toner is smoothly conveyed to the toner separation section 60. In the steady operation after the fluid flow is formed, the toner is smoothly conveyed to the toner separation section 60 by the operations of the pumps 501 and 502.

By some cause or other, if the pump 501 starts earlier than the pump 502, a negative pressure is temporarily generated in the mixing chamber 35, which may make the fluid conveyance from the mixing chamber 35 to the separation section 60 unsmooth. Therefore, the starting time of the pump 502 is set to be the same as or earlier than the starting time of the pump 501. In other words, setting the starting time of the pump 502 to be the same as or earlier than the starting time of the pump 501 prevents this problem. Timing control, such as starting the pump 501 at time t2 that is after the starting time t1 of the pump 502, as shown in FIG. 11, is an example of this kind of controls.

In stopping toner supply, the pump 501 stops earlier than the pump 502, and thereby pressure rise in the toner hopper 70 can be prevented.

If a timing control such as that described above is not performed, and, for example, the pump 502 stops earlier, the fluid is conveyed by the pump 501 to the toner hopper 70, resulting in a temporary pressure rise in the toner hopper 70.

This pressure rise may disperse toner from the developing device and the like communicated with the toner hopper 70.

By setting the stopping time of the pump 502 to a time same as or later than the stopping time of the pump 501, that is, by controlling the pumps 501 and 502 such that the pump 502 stops at the same time or after the pump 501 stops, such dispersion of toner can be properly prevented. The timing control, shown in FIG. 11, that stops the pump 502 at time t4 later than the sopping time t3 of the pump 501 is an example of such control.

Figure 11:
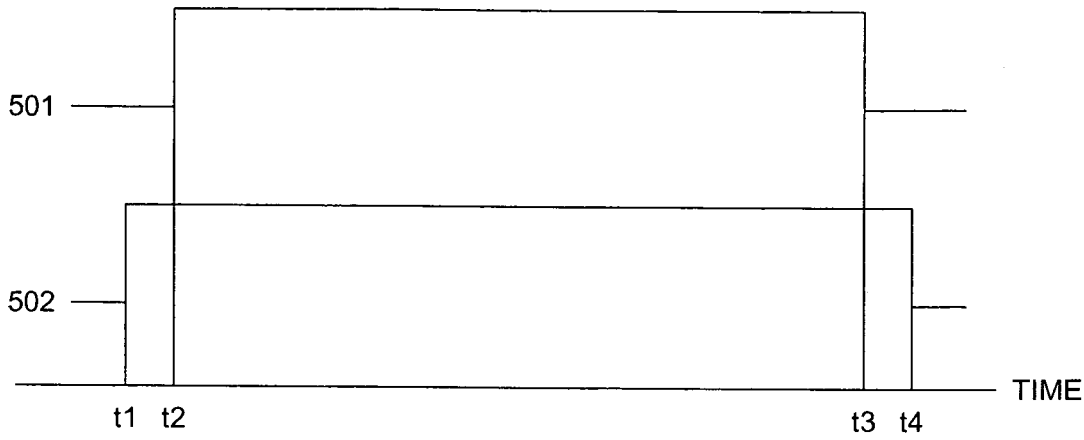
FIG. 11 is a diagram showing an example of the operation timing of pumps.

Time differences between t2 and t1 and between t4 and t3 in FIG. 11 are preferably between 0.2 sec and 5 sec.

(8) Abnormality Detection

If the toner supplying device continues to operate, while having a clog, it becomes difficult to remove the clogged toner. Therefore, it is necessary to stop the operation quickly.

In the invention, to prevent abnormal operations such as clogging like this, a detection system for early detection of abnormalities is provided.

First abnormality detection means is comprised of, for example, encoder 90, an optical sensor 91, and control means CR, as shown in FIGS. 5 and 10, and detects rotation abnormality of the pump 501, or mostly detects clogging of the conduits 40 or 41 with toner.

The encoder 90 is fixed to the rotary shaft of the motor 55, and rotation of the motor 55 is monitored by the optical sensor 91 that detects the rotation of the encoder 90.

If clogging with toner has occurred, the motor 55 is abnormally loaded and the rotation speed thereof drops. Therefore, the rotation speed of the encoder 90 is detected by the optical sensor 91 to detect clogging. Specifically, a threshold of the rotation speed is set in monitoring the rotation speed, wherein when the rotation speed of the motor 55 drops down equal to or below the threshold, the control means CR stops the motor 55.

If clogging with toner has occurred and thereby the motor 55 is loaded, there occurs a change in the rotation of the motor 55. This change in the rotation speed may be determined by detection of a change in voltage or a change in current amount.

The first abnormality detection means may also be installed on the pump 502.

Second abnormality detection means is comprised of the toner sensor PZ3 arranged in the mixing chamber 35 and the control means CR.

The mixing chamber 35 is provided, as shown in FIG. 2, with, the toner sensor PZ3 being a piezoelectric element, which detects that the mixing chamber 35 is full of toner.

In the case where toner is not conveyed from the toner feeding section TA to the toner separation section 60 even when the pumps 501 and 502 operate in response to a toner supply command signal, the mixing chamber 35 turns out to be full. The toner sensor PZ3 detects such a full state of the mixing chamber 35, and the control means CR outputs an abnormality signal. The control means CR may be arranged such that the control means CR measures the time period of the full state of the mixing chamber 35, and outputs an abnormality signal if the state is maintained for a predetermined time.

Thus, it is possible to prevent an increase in clogging with toner in the conduits 40 and 41 which could be caused by uncontrolled operation of the pumps 501 and 502.

Third abnormality detection means is comprised of, for example, the toner sensor PZ4 provided in the toner hopper 70 and the control means CR.

As mentioned above and shown in FIGS. 7 and 8, the toner sensor PZ4 of a piezoelectric element is disposed in the vicinity of the bottom of the toner hopper 70. If toner supply is not performed or it is not enough, the toner sensor PZ4 detects that a required amount of toner is not left in the toner hopper 70. Specifically, if toner is not detected by the toner sensor PZ4 even after toner supply is carried out for a predetermined time, the control means CR determines that there is an abnormality. Thus, abnormality detection is performed.

For example, if the conduits 40 and/or 41 is unfixed or air leakage occurs in the fluid circulation system, toner is not supplied even when the pumps 501 and 502 operate. Such conveyance failures can be detected at an early stage by the toner sensor PZ4.

If the toner sensor PZ4 does not detect that the toner level has risen to a level equal to or higher than the predetermined level even after the pumps 501 and 502 operate for a predetermined time, the control means CR determines a conveyance failure and outputs an abnormality signal.

At an arbitrary position in the toner conveyance route, fourth abnormality detection means is comprised of a sensor for detecting the air pressure state during toner conveyance, and the control means CR. For example, having been given in advance the knowledge of the air pressure state where toner is normally conveyed, the control means CR is set such that the control means CR determines occurrence of an abnormality such as clogging if a measured value greatly deviates from a normal pressure value.

When any of the abnormalities described above is detected, the control means CR stops the motor 39, the pumps 501 and 502, etc. to stop toner supply, and displays the abnormality.

With the above described abnormality detection system in a toner supply system, toner conveyance failure in the toner supply system is detected at an early stage, thereby preventing failure or the like of the apparatus.

With the use of any one or more of the aforesaid four abnormality detections, failures due to clogging with toner or the like can be prevented, wherein the abnormality detections are chosen and used as necessary.

What is claimed is:

1. An image forming apparatus comprising:

a toner supplying device;

a toner receiving device;

a first toner conduit communicating with the toner receiving device to feed toner supplied from the toner supplying device;

a first feeding device including a motor which forms an air stream to feed the toner through the first toner conduit; and a detector which monitors an abnormality condition in feeding of the toner from the toner supplying device by detecting rotation of an encoder fixed to a rotary shaft of the motor.

2. The image forming apparatus of claim 1, further comprising a control device which judges whether an abnormality occurs in feeding the toner based on information from the detector.

3. The image forming apparatus of claim 1, further comprising:

an image carrying member;

a developing device to develop a latent image on the image carrying member with the toner;

a transferring device to transfer the developed toner to an image support; and a fixing device to fix the toner on the image support.

4. An image forming apparatus comprising:

a toner supplying device;

a toner receiving device;

a first toner conduit communicating with the toner receiving device to feed toner supplied from the toner supplying device;

a first feeding device which forms an air stream to feed the toner through the first toner conduit; and a detector which monitors an abnormality condition in feeding of the toner from the toner supplying device;

wherein the toner supplying device includes a mixing section in which the toner and the air stream are mixed, and the detector is provided in the mixing section.

5. The image forming apparatus of claim 4, wherein the detector detects a toner amount in the mixing section.

6. The image forming apparatus of claim 5, wherein the detector detects whether the toner amount is at least a predetermined amount.

7. The image forming apparatus of claim 6, further comprising a control device which judges that an abnormality has occurred when the toner amount is at least predetermined amount.

8. An image forming apparatus, comprising:

a toner supplying device;

a toner receiving device including a toner storing device;

a first toner conduit communicating with the toner receiving device to feed toner supplied from the toner supplying device;

a first feeding device which forms an air stream to feed the toner through the first toner conduit;

a detector, which monitors an abnormality condition in feeding of the toner from the toner supplying device, and which is provided in the toner storing device and detects whether an amount of toner in the toner storing device is not more than predetermined amount; and a control device which judges that an abnormality has occurred when the detector detects that the amount of the toner in the toner storing device is not more than the predetermined amount.

9. The image forming apparatus of claim 8, wherein the control device judges that the abnormality has occurred when the detector detects that the amount of toner in the toner storing device is not more than the predetermined amount after toner supply is carried out for a predetermined time.

10. An image forming apparatus, comprising:

a toner supplying device;

a toner receiving device;

a first toner conduit communicating with the toner receiving device to feed toner supplied from the toner supplying device;

a first feeding device which forms an air stream to feed the toner through the first toner conduit;

a detector which monitors an abnormality condition in feeding of the toner from the toner supplying device; and a second toner conduit communicating with the toner receiving device and the toner supplying device to lead at least the air stream from the toner receiving device toward the toner supplying device.

11. The image forming apparatus of claim 10, further comprising a second feeding device to assist flow of the air stream.

12. The image forming apparatus of claim 11, wherein the second feeding device is activated at a same or earlier time than an activation time of the first feeding device.

13. The image forming apparatus of claim 12, wherein the second feeding device is activated 0.2 to 5 seconds earlier than the activation time of the first feeding device.

14. An image forming apparatus, comprising:

a toner supplying device;

a toner receiving device;

a first toner conduit communicating with the toner receiving device to feed toner supplied from the toner supplying device;

a first feeding device which forms an air stream to feed the toner through the first toner conduit; and at least three detectors, which monitor an abnormality condition in feeding of the toner from the toner supplying device, and which include a first detector which detects an amount of the toner passing through the first feeding device, a second detector which detects an amount of the toner in a mixing section in which the toner and the air stream are mixed, and a third detector which detects an amount of toner in a toner storing device.

15. A toner supplying method comprising:

sucking toner contained in a toner supplying device by a first feeding device including a motor;

conveying the toner through a toner conduit to supply the toner to a predetermined position; and detecting an abnormality condition in the supply of the toner by detecting a rotation of an encoder fixed to a rotary shaft of the motor.

16. The method of claim 15, wherein the predetermined position includes a toner storing device comprising a detector, and the abnormality condition includes a condition in which an amount of toner in the toner storing device is not more than a predetermined amount.

17. A toner supplying method comprising:

sucking toner contained in a toner supplying device;

conveying the toner through a toner conduit to supply the toner to a predetermined position; and detecting an abnormality condition in the supply of toner;

wherein the toner supplying device includes a mixing section which forms air fluid including the toner, and the abnormality condition includes a condition in which a toner amount in the mixing section is at least a predetermined amount.

18. An apparatus for conveying toner from a toner container to a predetermined position, comprising:

a conduit communicating with the toner container and configured to lead the toner stored in the toner container to the predetermined position; and an air suction device configured to generate a negative pressure in the conduit and suck the toner stored in the toner container device, wherein the air suction device includes a motor for generating the negative pressure and a detector which detects an abnormality condition relating to toner supply by detecting a rotation of an encoder fixed to a rotary shaft of the motor.

19. An image forming apparatus comprising:

means for storing toner;

means for conveying the toner from the storing means to a prescribed position;

means for leading the toner stored in the storing means;

means for generating, with a motor, an air stream in the leading means to suck the toner stored in the storing means; and means for detecting an abnormality condition in toner supply by detecting a rotation of an encoder fixed to a rotary shaft of the motor.

* * * * *